US006247334B1

(12) United States Patent
Visser

(10) Patent No.: US 6,247,334 B1
(45) Date of Patent: Jun. 19, 2001

(54) CLOSURE FOR TATTOO-LIKE FASHION ACCESSORY

(75) Inventor: Marianne Lorraine Visser, Amsterdam (NL)

(73) Assignee: Home & Nature Inc., St. Cloud, MN (US)

( * ) Notice: Subject to any disclaimer, the term of this patent is extended or adjusted under 35 U.S.C. 154(b) by 0 days.

(21) Appl. No.: 09/252,748

(22) Filed: Feb. 19, 1999

(51) Int. Cl.[7] ..... A44C 5/00

(52) U.S. Cl. ..... 63/3; 63/3.1; 63/11; 63/DIG. 3; 24/122.6; 103/265

(58) Field of Search ..... 63/3, 3.1, 4, 11, 63/DIG. 3; 24/129 R, 122.6, 144.05, 115 H, 715.4; 403/265, 270

(56) References Cited

U.S. PATENT DOCUMENTS

| | | | | |
|---|---|---|---|---|
| 300,263 | * | 6/1884 | Jenks | 24/114.5 X |
| D. 411,812 | * | 7/1999 | Visser | D11/13 |
| D. 411,813 | * | 7/1999 | Visser | D11/13 |
| D. 411,964 | * | 7/1999 | Visser | D11/13 |
| D. 412,134 | * | 7/1999 | Visser | D11/13 |
| D. 413,829 | * | 9/1999 | Visser | D11/13 |
| D. 414,715 | * | 10/1999 | Visser | D11/13 |
| D. 414,716 | * | 10/1999 | Visser | D11/13 |
| D. 415,059 | * | 10/1999 | Visser | D11/13 |
| 3,059,518 | * | 10/1962 | Nelson | 24/715.4 X |
| 3,588,966 | * | 6/1971 | Thompson et al. | 403/265 |
| 4,322,077 | * | 3/1982 | Van't Hof | 24/115 H X |
| 6,056,147 | * | 5/2000 | Jarman | 220/495.11 |

* cited by examiner

*Primary Examiner*—Anthony Knight
*Assistant Examiner*—Andrea Chop
(74) *Attorney, Agent, or Firm*—Schweitzer Cornman Gross & Bondell LLP

(57) ABSTRACT

A fastening closure arrangement is provided for securing loose ends of the elements forming a tattoo-like fashion accessory formed of plastic monofilament line. The accessory article is formed in an artistic pattern of interconnected loops, with a closed loop at one end and two or more ends of the monofilament line at the other end. The ends of the monofilament lines are brought together in side-by-side relation and a locking collar is applied over the loose ends. End extremities of the monofilament elements, projecting beyond the collar, are fused and pressed, preferably with heat, to form a flange, which secures the collar against removal. To particular advantage, a pair of monofilament ends are arranged in straddling relation to a closed loop at the opposite end of the fashion accessory article such that, when the locking collar is applied and secured, the accessory article is secured in a closed ring, suitable for an armband, wristband, necklace or the like. The arrangement provides an inexpensive, highly effective and unobtrusive way to secure the monofilament ends of the fashion accessory article and, also to secure the article in the configuration of a closed ring.

3 Claims, 1 Drawing Sheet

CLOSURE FOR TATTOO-LIKE FASHION ACCESSORY

BACKGROUND AND SUMMARY OF THE INVENTION

The present invention is directed to a fashion accessory article, and more particularly to a novel, simplified, economical and yet highly effective closure device for securing the accessory article in a closed configuration and/or for securing loose ends of the constructed device without securing the device itself in closed configuration.

A new and attractive form of fashion accessory article is constructed of thermoplastic monofilament elements of a size and character to have a degree of stiffness and resiliency. A wide variety of artistically unique and highly attractive fashion accessory articles can be formed using one or more lengths of the plastic monofilament, formed by a series of interconnected loops in a continuous, chain-like manner. The resulting device is typically of somewhat elongated, strip-like form comprised of a series of repeating interconnected loops. The resulting design, although relatively simple, is artistically highly attractive, and products incorporating these artistic designs have been marketed very successfully.

In the construction of the accessory articles, a continuous length of monofilament element, which may be single or combined with one or more similar elements, is formed into a starting loop in the region of a midpoint between its ends. The portions of the monofilament element(s) on either side of the starting loop are looped and intertwined in various predetermined patterns, often but not necessarily using the same pattern for a given article, to form the desired artistic pattern.

At the end of the completed article opposite the starting loop, the free ends of the monofilament elements must be secured. Additionally, where desired, the constructed fashion accessory article may be joined at its opposite ends to form a circular element usable as an armband, wristband, necklace, etc. Pursuant to the present invention, a novel and improved arrangement is provided for securing the free ends of the monofilament and, where desired, forming the article to a closed loop. The arrangement of the invention involves the placement of a small locking collar over the loose free ends of the monofilament, and then fusing the end portions, preferably under heat and pressure, to join the ends and to flatten and deform the end extremity into a flange-like portion which prevents removal of the collar.

Where the accessory article is to be formed into a closed ring, separate ends of the monofilament free ends are placed in straddling relation to elements forming the starting loop, such that the starting loop is captured and secured when the locking collar is put in place and the monofilament ends are fused and flanged.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 1:
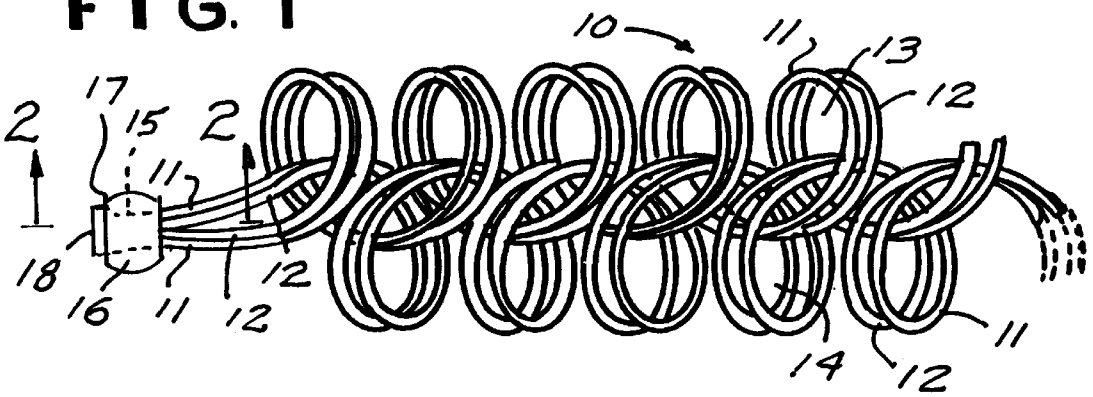
FIG. 1 is a top plan view showing a short section of a fashion accessory article of the type contemplated, illustrating the manner in which the free ends of the monofilament are secured in accordance with the invention.

Referring now to the drawings, the reference numeral 10 designates generally a fashion accessory article of the type contemplated by the invention. The device shown in FIG. 1 is constructed of pairs of thermoplastic monofilament line, similar in nature to monofilament fishing line, for example. In the illustration of FIG. 1, the pairs of monofilament lines 11, 12 are formed into a series of interconnecting upper and lower loops 13, 14, with each lower loop interlaced with each upper loop. Because of the inherent stiffness and elasticity of the monofilament lines, the loops 13, 14 tend to project laterally from the center portion, forming an attractive chain loop design.

When constructing the series of linked loops 13, 14, the pairs of filaments 11, 12 may be held near their midpoint and interlaced in successive loops until the strip-like accessory device is at a desired length, or the ends of the monofilament elements have been reached. At the end of the article from which the linking was commenced, there will be a closed loop formed by the midpoint of the monofilament lines. At the opposite end, there will be the loose ends of the monofilament, in this case four such loose ends. These must be secured in some manner to prevent unravelling of the device.

Figure 2:
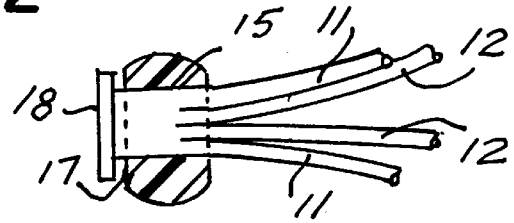
FIG. 2 is an enlarged, fragmentary cross sectional view as taken generally on line 2—2 of FIG. 1, showing details of the closure arrangement.

Pursuant to the invention, the loose ends 11, 12 are bunched together tightly and inserted through a through passage 15 formed in a locking collar 16. The locking collar 16 may be of any desired configuration, but preferably is more or less spherical in its contours. The bunched ends of the monofilament elements are projected through the collar 16 and at least slightly beyond the end 17 thereof. The thus projected ends are then fused, preferably by being subjected to heat and pressure, sufficient not only to fuse the four strands together, but also to expand or "mushroom" the fused extremity to form an enlarged flange 18. The flange 18, as shown particularly in FIG. 2, is of greater diameter than the opening 15 in the collar 16, so that once the monofilament ends are fused and mushroomed, the collar cannot be removed.

Typically, the collar 16 will be free to slide on the bunched monofilament lines. However, because the normal elasticity and stiffness of the monofilament tends to spread the lines apart, the collar 16 normally tends to position itself immediately adjacent the end flange 18.

Figure 3:
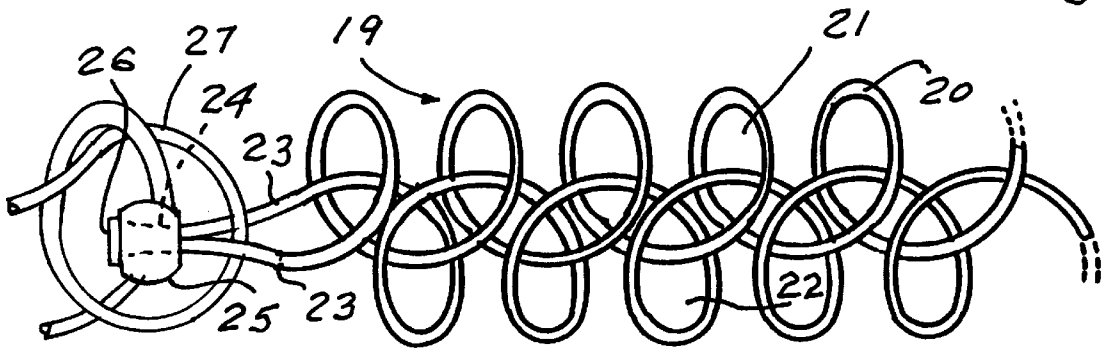
FIG. 3 is a top plan view of a section of another embodiment of the fashion accessory article showing the manner in which the closure arrangement of the invention is utilized to secure opposite ends of the accessory article, to form it into a ring, or to chain two sections together.

In the illustration of FIG. 3, a fashion accessory article 19 is formed with a single monofilament line 20, which is initially held near its midpoint, and the opposite half lengths thereof are interlaced in successive oppositely directed loops 21, 22. At the far end of the accessory device, the free ends 23 of the monofilament are brought together and inserted through the opening 24 in locking collar 25 and secured therein, as by being subjected to heat and pressure, to fuse the two ends together and mushroom the extremity to form a retaining flange 26.

Figure 4:
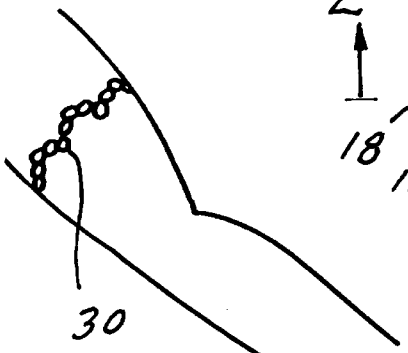
FIG. 4 is a simplified illustration, showing how the accessory article, when formed into a ring, can serve as a tatoo-simulating armband, for example.

In the illustration of FIG. 3, however, it will be seen that the two ends 23 of monofilament are arranged in straddling relation to a closed loop 27. The loop 27 typically will be the closed loop at the starting end of the same article 19. With the starting loop thus captured between the straddling and secured ends 23, the article 19 is configured in the form of a closed ring. In such a configuration, the accessory device may be utilized as an armband 30, as shown in FIG. 4, or other accessory article, such as a wristband, necklace, etc.

The locking collar may be formed of a variety of materials including plastic materials. If formed of thermoplastic materials, the collar must of course be momentarily held displaced while the end extremities of the monofilament elements are fused and mushroomed.

The closed loop 27 also could be of a separate article, resulting in the chaining together of two articles.

The closure arrangement of the invention is particularly advantageous in that it is simple and inexpensive, economically applied and can be made to be visually unobtrusive, so as not to interfere with the artistic aspects of the accessory article.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. The combination of a fashion accessory article formed in a strip-like configuration of successive interlocking loops of a thermoplastic monofilament line and having at a first end thereof, a plurality of free ends of monofilament line, and a closure arrangement, said fashion accessory article being formed with a closed loop at a second end of the article, said closure arrangement comprising, (a) a locking collar having a through opening therein for the reception of said free ends, said free ends being positioned in straddling relation to a monofilament section forming part of said closed loop at said second end of said article, and said free ends being passed through said opening and projecting beyond said collar, (b) end extremities of said free ends, projecting beyond said collar, being fused together, (c) the fused end extremities being permanently distorted to form an enlarged flange-like element of a size and shape larger than said through opening, to thereby permanently secure said free ends in attached relation to said closed loop, and whereby said fused end extremities cannot be withdrawn from said locking collar.

2. A combination according to claim 1, wherein (a) said closed loop and said free ends are formed at opposite ends of said fashion accessory article, and (b) said fashion accessory article is formed into a closed, ring-like configuration.

3. A combination according to claim 1, wherein (a) said article is formed of multiple strands of monofilament line configured as parallel strands.

* * * * *